US009339824B2

(12) United States Patent
Henne

(10) Patent No.: US 9,339,824 B2
(45) Date of Patent: May 17, 2016

(54) DRIVE HEAD FOR DETACHABLE CONNECTION OF A DRIVE WITH A ROTOR OF A CENTRIFUGE, KIT COMPRISING SUCH A DRIVE HEAD, AND CENTRIFUGE

(71) Applicant: Thermo Electron LED GmbH, Langenselbold (DE)

(72) Inventor: Sebastian Henne, Goettingen (DE)

(73) Assignee: Thermo Electron LED GmbH, Langenselbold (DE)

( * ) Notice: Subject to any disclaimer, the term of this patent is extended or adjusted under 35 U.S.C. 154(b) by 0 days.

(21) Appl. No.: 14/622,952

(22) Filed: Feb. 16, 2015

(65) Prior Publication Data

US 2015/0231648 A1 Aug. 20, 2015

(30) Foreign Application Priority Data

Feb. 17, 2014 (DE) ..... 10 2014 002 126

(51) Int. Cl.
*B04B 9/08* (2006.01)
*B04B 9/00* (2006.01)

(52) U.S. Cl.
CPC ... *B04B 9/00* (2013.01); *B04B 9/08* (2013.01); *B04B 2009/085* (2013.01)

(58) Field of Classification Search
CPC ..... B04B 9/08; B04B 2009/085; B04B 9/00
USPC ..... 494/12, 16, 20, 33, 38, 64, 84, 85; 210/232
See application file for complete search history.

(56) References Cited

U.S. PATENT DOCUMENTS 2,329,499 A 9/1943 Weaver
6,063,018 A * 5/2000 Letourneur ..... B04B 9/08 403/327

(Continued)

FOREIGN PATENT DOCUMENTS

DE 19930593 A1 * 4/2000 ..... B04B 9/08
DE 10 2008 045 556 A1 3/2010

(Continued)

OTHER PUBLICATIONS

Espacenet, English Machine Translation of EP0911080A1, published Apr. 28, 1999, retrieved from http://worldwide.espacenet.com on Jan. 25, 2015 (11 pages).

(Continued)

*Primary Examiner* — Charles Cooley
(74) *Attorney, Agent, or Firm* — Wood, Herron & Evans, LLP

(57) ABSTRACT

The present invention relates to a drive head for detachable connection of a drive with a rotor of a centrifuge, comprising: a base body which is rotatable about an axis of rotation (R) and at least one coupling element, which is mounted on the base body such that it is movable between a release position (F) and a locking position (V), the coupling element protruding further beyond the outer circumference of the base body in the locking position (V) than in the release position (F). The coupling element is arranged so as to be linearly movable between the release position (F) and the locking position (V) in such a way that a plane (E), along which the coupling element is movable, is inclined relative to a sectional plane (S) extending perpendicularly to the axis of rotation (R), the coupling element having a resting surface in its outer end region, which runs parallel to the sectional plane (S). The present invention further relates to a kit comprising the drive head and to a centrifuge comprising the drive head or the kit.

16 Claims, 7 Drawing Sheets

(56) References Cited

U.S. PATENT DOCUMENTS

| | | | | |
|---|---|---|---|---|
| 8,678,987 | B2 * | 3/2014 | Henne | B04B 9/08 494/12 |
| 8,852,070 | B2 * | 10/2014 | Peters | B04B 9/08 494/12 |
| 2013/0188894 | A1 * | 7/2013 | Peters | B04B 9/08 384/91 |
| 2013/0237399 | A1 * | 9/2013 | Letourneur | B04B 9/08 494/10 |
| 2013/0331253 | A1 * | 12/2013 | Ballhause | B04B 9/00 494/84 |
| 2015/0231648 | A1 * | 8/2015 | Henne | B04B 9/08 494/84 |
| 2015/0343459 | A1 * | 12/2015 | Ballhause | B04B 9/00 |

FOREIGN PATENT DOCUMENTS

| | | | |
|---|---|---|---|
| DE | 10 2012 011 531 | A1 | 12/2013 |
| EP | 0 911 080 | A1 | 4/1999 |
| JP | 2601042 | B2 * | 4/1997 |

OTHER PUBLICATIONS

Espacenet, English Machine Translation of DE102008045556A1, published Mar. 4, 2010, retrieved from http://worldwide.espacenet.com on Jan. 25, 2015 (9 pages).

Espacenet, English Machine Translation of DE102012011531A1, published Dec. 12, 2013, retrieved from http://worldwide.espacenet.com on Jan. 25, 2015 (15 pages).

German Patent Office, Search Report for DE102014002126.2, mailed Nov. 5, 2014 (2 pages).

* cited by examiner

DRIVE HEAD FOR DETACHABLE CONNECTION OF A DRIVE WITH A ROTOR OF A CENTRIFUGE, KIT COMPRISING SUCH A DRIVE HEAD, AND CENTRIFUGE

CROSS-REFERENCE TO RELATED APPLICATIONS

The present application claims priority under 35 U.S.C. §119 of German Patent Application No. 10 2014 002 126.2, filed Feb. 17, 2014, the disclosure of which is hereby incorporated herein by reference in its entirety

FIELD OF THE INVENTION

The technical field of the present invention relates to centrifuges that hold sample containers and are used for separating the constituents of the samples contained therein at a high rotational speed of a centrifuge rotor.

More particularly, the present invention relates to a drive head for detachable connection of a drive to a rotor of a centrifuge, which drive head comprises a base body and at least one coupling element, which is mounted on the base body such that it can be moved between a release position and a locking position. The coupling element protrudes further beyond the outer circumference of the base body in the locking position than in the release position, and comes to rest against the rotor, thereby locking the rotor to the drive head in such a way that the former cannot be separated from the latter. The present invention further relates to a kit for a centrifuge, which kit consists of a drive head and at least one hub for a rotor. Finally, the present invention also relates to a centrifuge comprising the drive head or the kit.

BACKGROUND OF THE INVENTION

The prior art discloses a number of solutions by means of which a rotor of a centrifuge can be mounted firmly on a drive shaft. For example, it is known to press the rotor onto a conical seat of a drive shaft by means of a screw thread.

Self-locking attachments are also known, for example, from EP 0 911 080 A1. However, the described system is only suitable for specific rotor types that do not generate any forces (for example, buoyancy forces) contrary to the coupling direction.

DE 10 2008 045 556 A1 develops the principle of EP 0 911 080 A1 explicitly provides for counteracting buoyancy forces up to a force of approximately 100 N. At forces below this value, unlocking in the axial direction is impossible. However, this system reaches its limits when higher buoyancy forces and/or very high rotational speeds occur. In the case of high buoyancy forces and simultaneous twisting of the coupling elements, or in the case of diminished friction pairing properties, the self-locking feature of the system is overridden and unlocking in the axial direction can occur. Furthermore, the rotor gets jammed as a result of the high centrifugal forces at very high rotational speeds and the coupling cannot always be easily detached.

DE 10 2012 011 531 A1 discloses a versatile system suitable for mounting a great variety of different rotors on a drive head in a self-locking manner. The drive head has various types of coupling elements, which swivel into associated recesses in the rotor either separately or in combination with each other depending on the respective rotor to be connected. The self-locking is achieved by appropriate arrangement of sloped ramp faces on the coupling elements and the rotor. In terms of manufacturing, this is relatively expensive.

It is thus an object of the present invention to overcome the disadvantages of the prior art described above. More particularly, it is an object of the present invention to provide a drive head comprising a self-locking and quickly detachable coupling as well as a kit for a centrifuge and a centrifuge comprising said drive head, which can be manufactured at a lower cost without any loss in terms of reliability and ease of operation.

SUMMARY OF THE INVENTION

According to a first aspect, the present invention relates to a drive head for detachable connection of a drive with a rotor of a centrifuge, which drive head comprises a base body which is rotatable about an axis of rotation and at least one coupling element, which is mounted on the base body so as to be movable between a release position and a locking position. The coupling element protrudes further beyond the outer circumference of the base body in the locking position than in the release position. Thus, the locking takes place basically as in the case of DE 10 2012 011 531 A1 or DE 10 2008 045 556 A1 in that the coupling element protruding in its locking position beyond the outer circumference of the base body engages the rotor and, by way of this engagement, fixes the rotor to the drive head. However, in contrast to the above-described prior art references, the transfer of the coupling element from the release position, in which the rotor can be separated from the drive head, to the locking position does not take place by way of a swiveling movement, but through linear displacement in such a way that the displacing movement occurs at an inclination with respect to the axis of rotation and to a plane intersecting the latter perpendicularly, hereinafter referred to as sectional plane. The sectional plane and the plane, in which the displacement movement of the respective coupling element takes place, thus extend at an angle to each other.

The contact between the coupling element and the rotor to achieve the locking is established via a linear movement. This is easier to implement than the swiveling movement of the coupling elements according to the prior art described above. Moreover, in case of swiveling, depending on the tolerances, practically no surface contact is achieved between the contact surfaces, but normally only a line contact or point contact takes place, which results in very high contact pressure which can lead to wedging of the coupling element and the rotor. In case of the linear movement according to the present invention, in contrast, the contact surfaces move toward each other in parallel orientation. Thus, contact is ensured to occur over a larger surface area and wedging of the contact surfaces is impossible. Moreover, in case of the swiveling movement, the swiveling in the desired end position of the coupling element, in which secure self-locking is already achieved before the rotational movement of the rotor starts, can be hindered due to soiling of the contact surfaces of the coupling element and the rotor. For example, dust particles sometimes restrict the complete swiveling of the coupling element and thus prevent it from swiveling in the desired end position. In case of linear positioning of the resting surface of the coupling element on the contact surface of the rotor, this disturbance is practically avoided.

Another advantage of the present invention is that, in contrast to the described prior art, the resting surface of the coupling element is plane and—intersecting the axis of rotation perpendicularly and running parallel to the sectional plane—extends horizontally. As a result, the associated contact surface on the rotor, on which the resting surface of the coupling element comes to rest in a locking position, can likewise be designed as flat and horizontal. This facilitates the manufacturing considerably and reduces the cost of the overall construction.

Sliding of the coupling element in the direction toward the rotor to lock it with the drive head occurs preferably inclined in the downward direction as regarded from the mounting side of the rotor. The angle of inclination of the plane in which the displacement of the coupling element takes place relative to the sectional plane which intersects the rotational axis of the drive head perpendicularly, is chosen appropriately depending on the materials of the coupling element and the rotor. This is done under consideration of the friction coefficients of the resting surface of the coupling element on the one hand and the associated locking surface of the rotor, on which the resting surface of the coupling element comes to rest, on the other hand. The stability of the self-locking that results from the contact of the resting surface of the coupling element with the associated locking surface of the rotor depends on the selected material combination on the one hand and on the angle at which the two contact surfaces are pressed against each other on the other hand. As described in DE 10 2008 045 556 with reference to FIGS. 3 and 4, self-locking occurs if the angle $\alpha$, which describes the inclination of the contact surface, is smaller than arc tan $\mu_0$, wherein $\mu_0$ is the friction coefficient of the material combination used. Normally, steel is used for the coupling element as well as for the rotor. The friction coefficient $\mu_0$ for a steel-steel-combination is 0.3 for dry surfaces. This means that, with respect to the present invention, a particularly preferable angle of inclination $\alpha$ of the displacement plane relative to the sectional plane is at most 17°, and, in particular, in the range of 10 to 17°. However, for other material combinations other angles of inclination $\alpha$ may be selected. Overall, preferred angles of inclination for the present invention range from 5 to 30° and, more preferably, from 10 to 20 °.

The inclined displacement of the coupling element allows for the resting surface with which the coupling element rests on the rotor to be designed horizontally. Accordingly, the at least one locking surface of the rotor, on which the resting surface of the coupling element comes to rest, can likewise be constructed horizontally. This facilitates the manufacturing of the rotor and reduces the cost considerably. For example, the locking surface in the rotor can be created in that a circular groove of rectangular cross-sectional shape in the radial direction is milled, or otherwise worked, into the lateral surface of the rotor hub, which surrounds the central opening in the rotor for accommodating the drive head. Alternatively, the resting surface of the at least one coupling element can simply come to rest on a top edge of the hub of the rotor and in this manner lock the rotor to the drive head. In each case, the creation of the horizontal locking surface is considerably simpler than creating the same with a particular inclination, as was necessary in the prior art.

Apart from the different orientation of the at least one coupling element compared to the prior art, it can be otherwise constructed similar to the coupling elements of the above cited references. For example, the coupling element can have an upper cover face facing towards the mounting side of the rotor and a lower cover face more remote from the mounting side of the rotor. Both cover faces are preferably even and run parallel to each other. The cover faces are arranged appropriately in such a way that they also run parallel to the plane in which the movement of the coupling element takes place.

Preferably, more than one coupling element is used per drive head. These coupling elements may be identical or differ from each other. In a preferred variant of the present invention, two or three identical coupling elements are evenly distributed in the circumferential direction and, in particular, at the same level of the drive head around its outer circumference, in order to ensure uniform and tilt free arresting of the rotor. However, it is also possible to use non-identical coupling elements, as described in DE 10 2012 011 531 A1. The latter is particularly preferred for more than two and especially more than three coupling elements, of which at least one is located at a different level of the drive head compared to the other ones. It is basically also possible to combine linearly movable and swiveling coupling elements with each other. However, using only the linearly movable coupling elements is preferred.

For guiding the coupling element during movement, it is arranged appropriately in a recess in the base body in such a way that the upper cover face rests flat against an upper boundary surface of the recess, and the lower cover face against a lower boundary surface. These boundary surfaces of the recess are also oriented appropriately in such a way that they run parallel to the plane of movement, in which the coupling element is moved linearly. The recesses for the coupling element are preferably designed as a groove which has been worked, for example, milled, into the outer circumference of the base body, and which preferably has a rectangular cross-sectional shape as regarded transversely to the direction of movement. The recess is thus open toward the outside of the base body so that the coupling element can be easily inserted in the recess. The coupling element may be mounted in any way in the associated recess so that it is displaceable. As is already known from the prior art, it is preferably arranged under a pre-tension by an elastic element such as, for example, a spring in such a way that the coupling element is pushed into the locking position. The movement from the locking position into the release position, in which the rotor can be separated from the drive head, therefore occurs against the spring load.

For guiding the coupling element in the direction of displacement and thus for linear movement from the release position into the locking position and back, guiding means such as a guide projection in combination with a guide groove may further be provided, which are arranged on the coupling element on the one hand and on the base body of the drive head on the other hand. For example, the coupling element may have a linear guide groove, along which a guide projection can slide, which projects from the base body. It is preferable if two guide projections are provided per coupling element, which are arranged adjacent to each other and engage a guide groove to thus provide for linear movement.

The resting surface, with which the coupling element rests against the locking surface of the rotor for locking, is preferably located on the side of the coupling element facing away from the mounting side of the rotor. In this way, unintended lifting of the rotor from the drive head is especially reliably prevented. As has been described above, the coupling element preferably automatically moves into the locking position in that it is slid out of the base body by means of the elastic element in the direction of the rotor as soon as the rotor is in the locking position on the drive head. Upon the rotor reaching the locking position, self-locking takes place automatically which will prevent the rotor from being detached from the drive head unintentionally. For detaching the rotor, a release device must be actuated with which the coupling element is pushed back from the locking position into the release position against the spring load. The release device can be constructed using suitable positioning elements such as, for example, sliders, as is generally already known in the prior art.

The basic shape of the drive head itself may also correspond to the shape of the drive heads known in the art. As regarded in the mounting direction of the rotor, it preferably comprises an upper region having an essentially cylindrical outer contour, and a lower region shaped as a truncated cone adjoining the upper region. The combination of cylindrical region and truncated cone region enables easy centering of the rotor on the drive head. Particularly, secure positioning is achieved if a further cylindrical region adjoins the truncated cone region.

Besides the drive head, the present invention relates to a kit for a centrifuge which comprises the drive head and a hub for a rotor. The hub for the rotor may either be integrated in the rotor itself so as to form a single piece, or it may be a separate part that is inserted in an internal opening of the rotor. In the latter case, the hub is generally designed as a sleeve. The hub has at least one locking surface, which runs parallel to the sectional plane and thus perpendicular to the axis of rotation of the drive head and serves to accommodate the resting surface of the coupling element. If the hub is positioned on the drive head and thus the at least one coupling element is in its locking position, its resting surface comes to rest on the locking surface and in this manner locks the rotor associated with the hub to the drive head. In one possible variant, a separate locking surface exists for each resting surface of a coupling element. For easier manufacturing, it is, however, preferred to provide one common locking surface for several or all resting surfaces. Such common locking surface can be designed in a ring shape, in particular, in such a manner that it makes contact with the resting surfaces of at least two coupling elements of the drive head in the locking position if the hub is positioned on the drive head. In the hub, or the rotor, only one locking surface therefore needs to be created, the contact surface of which can moreover extend horizontally, which facilitates the manufacturing of the hub or the rotor considerably compared to the prior art.

The present invention finally also relates to a centrifuge, which comprises either the described drive head or the kit according to the present invention.

BRIEF DESCRIPTION OF THE DRAWINGS

The present invention is explained in greater detail with reference to the attached figures. The figures are merely schematic and only serve to describe several preferred embodiments, which, however, are not to be understood as restricting the present invention. Like reference numerals denote like components. In the schematic figures.

DETAILED DESCRIPTION OF THE INVENTION

Figure 1:
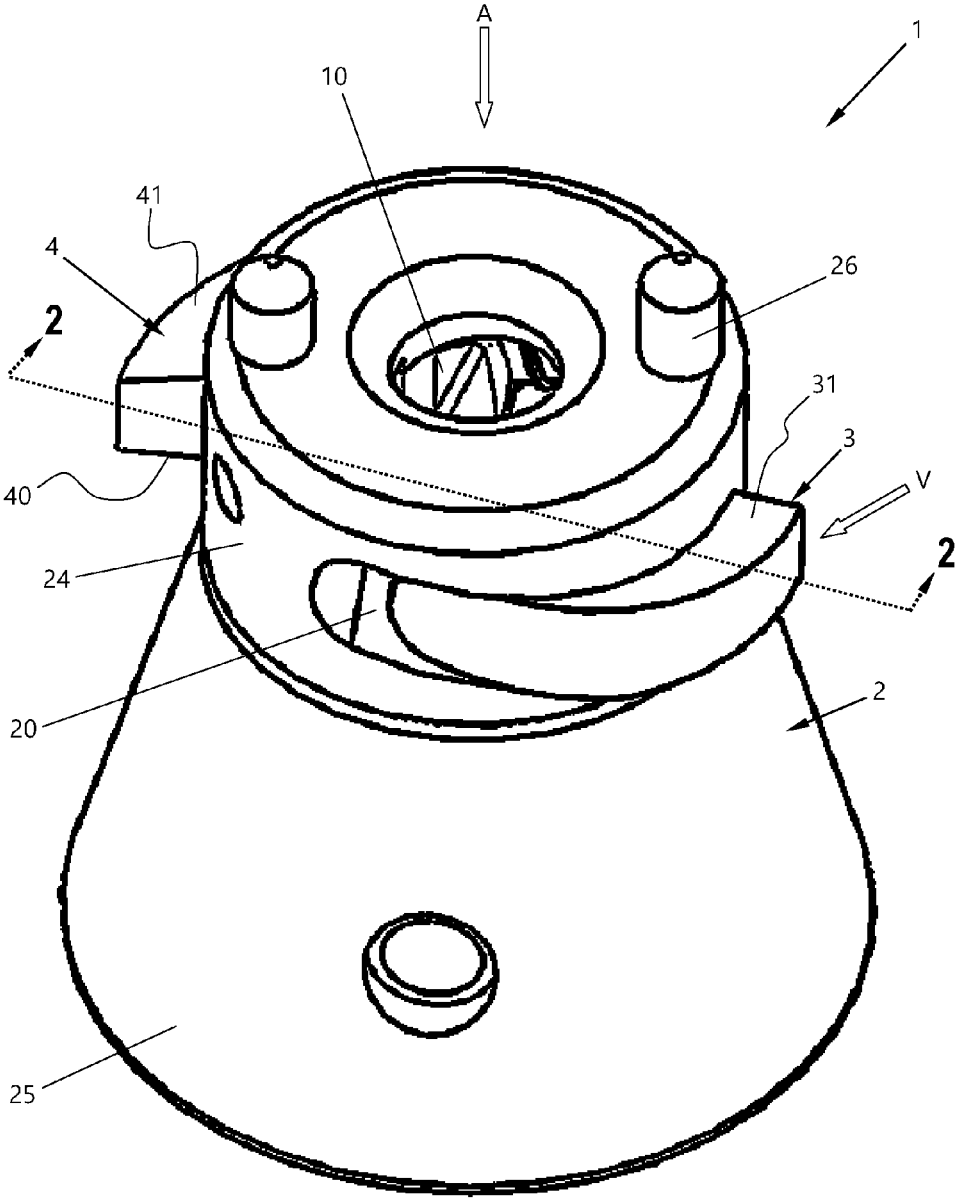
FIG. 1 is a perspective view of a drive head according to the present invention.

FIG. 1 shows a perspective view of a drive head 1 according to the present invention. This drive head is fixed to a drive shaft of a motor of a centrifuge that is not illustrated here and serves the purpose of driving a centrifuge rotor. The drive head 1 comprises a base body 2 with an essentially cylindrical upper region 24 and an adjoining region 25 shaped as a truncated cone. In the upper cylindrical region 24, two elongated openings are provided in the outer circumference of the base body 2 which extends along the circumference for accommodating coupling elements 3 and 4, of which openings only the first opening 20 for accommodating the coupling element 3 is shown here. The opening for accommodating the coupling element 4, which is not shown, extends in a like manner on the rear side of the base body 2. The coupling elements 3 and 4 are mounted in the openings so that they are linearly movable. In FIG. 1, both coupling elements 3 and 4 are in their locking position, which is designated here by V. In their locking position, the coupling elements 3 and 4 protrude with one of their ends beyond the outer circumference of the cylindrical region 24 of the base body 2, so that their resting surfaces, of which only the resting surface 40 of the second coupling element 4 is shown here, protrude beyond the base body 2. While attaching a rotor in the mounting direction A on the drive head 1 or while unlocking, the coupling elements 3 and 4 are pushed back into the base body 2 to such an extent that the ends of the coupling elements accommodated in the base body 2 hit the face side ends of the receiving openings in the base body and the opposite ends of the coupling elements 3 and 4 either do no longer protrude beyond the outer circumference of the base body 2, or only to such an extent that the rotor can be removed from the drive head 1. The pin-shaped projections 26 serve to align and hold the rotor, which has corresponding recesses for accommodating the projections 26, on the drive head 1. A central opening 10 in the upper region of the drive head 1 enables the access to the internal area of the drive head and thus facilitates the installation and maintenance of the coupling elements 3 and 4 inside the drive head 1.

Figure 2:
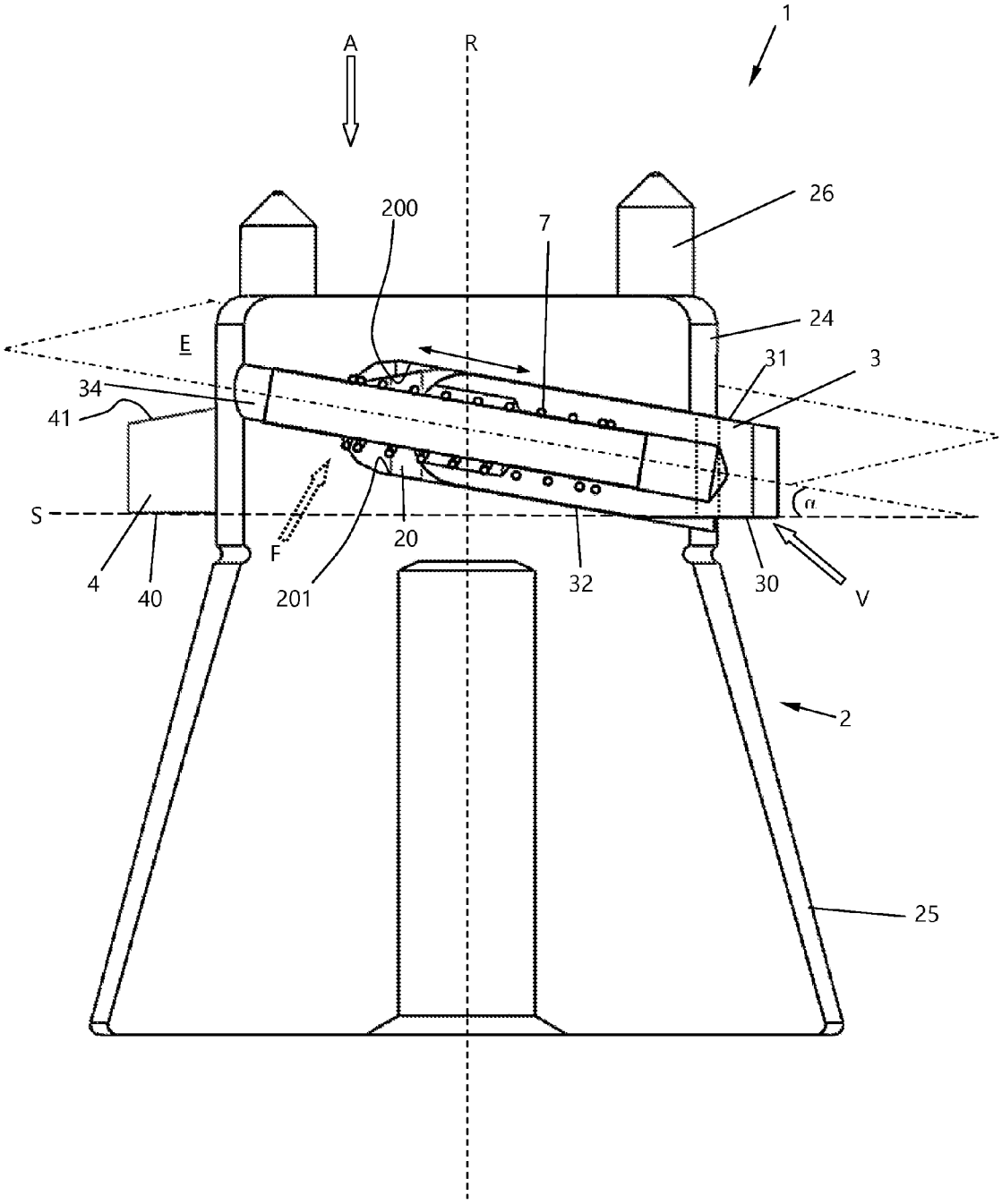
FIG. 2 is a cross-sectional view of the drive head of FIG. 1 along line 2-2.

FIG. 2 shows a cross-sectional view of the drive head 1 of FIG. 1 along the line B-B. The cross-section runs approximately centrally in the longitudinal direction through the coupling element 3. As can be seen, the receiving opening 20 for the coupling element 3 in the cylindrical region 24 of the base body 2 is designed so as to extend with a downward inclination away from the mounting direction A of the rotor. The opening 20 has an upper boundary surface 200 and a lower boundary surface 201, which run parallel to each other. The coupling element 3 is fitted in the opening 20 in such a way that its upper cover face 31 and its lower cover face 32 running parallel to each other rest flat on the respective boundary surfaces 200 and 201 and are thus guided in the opening 20 in the direction of movement during movement along the direction indicated by the double-headed arrow between the locking position V and the release position. The position of the front end of the coupling element 3 in the release position is indicated by two dashed vertical lines. In the release position, therefore, the free end is positioned such that the coupling element 3 is completely accommodated in the opening 20. As seen in FIGS. 1 and 2, the outer contour of the coupling element 3 is curved and follows the progression of the outer contour of the cylindrical region 24 of the base body 2. Thus, in the release position F, the coupling element 3 disappears completely in the opening 20 in the base body 2 and both surfaces extend flush with each other. The same applies to the coupling element 4, which is not shown here.

The coupling element 3 is mounted on a guide bar 34 fixed on the base body 2 and is displaceable along the former. A spring element 7 is fixed at the guide bar 34 and at the coupling element 3, by which spring element the coupling element 3 is set under pre-tension in such a way that it is automatically urged into the locking position V. For displacement into the release position F, the coupling element 3 must therefore be moved against the spring load of the spring 7. The movement between the release position F and the locking position V takes place within the movement plane E, which is inclined with respect to a sectional plane S, which perpendicularly intersects the axis of rotation R, about which the drive head 1 is rotated. The plane E is inclined at an angle $\alpha$ with respect to the sectional plane S in such a way that, as regarded in the mounting direction A of the rotor, the coupling element 3 is pushed from its release position F into the locking position V in a downwardly inclined manner. The resting surface 30, with which the coupling element 3 comes to rest on a corresponding locking surface of the hub of the rotor, is, however, designed horizontally and located in the sectional plane S. Coming from above at an angle, the resting surface 30 is thus brought to rest on the corresponding locking surface of the rotor hub during the locking process.

As already described in DE 10 2008 045 556 A1, the holding force with which the drive head and the rotor are attached to each other on the one hand depends on the static friction coefficient between the contact surfaces of the rotor and the drive head—in this case the resting surface of the coupling element and the locking surface of the rotor hub—and thus on the material properties of the two surfaces, and, on the other hand, on the angle of inclination with respect to the direction of the applied force. Steel is often used as the material for the contact surfaces. For a steel-steel combination for the resting surface of the coupling element and the locking surface of the rotor, the friction coefficient $\mu_0$ is approximately 0.3. In order to achieve self-locking between the two contact surfaces, and thus to prevent unintended detachment of the two surfaces from each other, the angle of inclination $\alpha$ should be smaller than arc tan $\mu_0$. The maximum angle $\alpha$ for a steel-steel combination is therefore 17°. In the case shown here, the angle $\alpha$ is set to approximately 15°. For other material combinations, a different angle may, however, be chosen. What has been described above with reference to coupling element 3 likewise applies to the identically designed coupling element 4.

Figure 3:
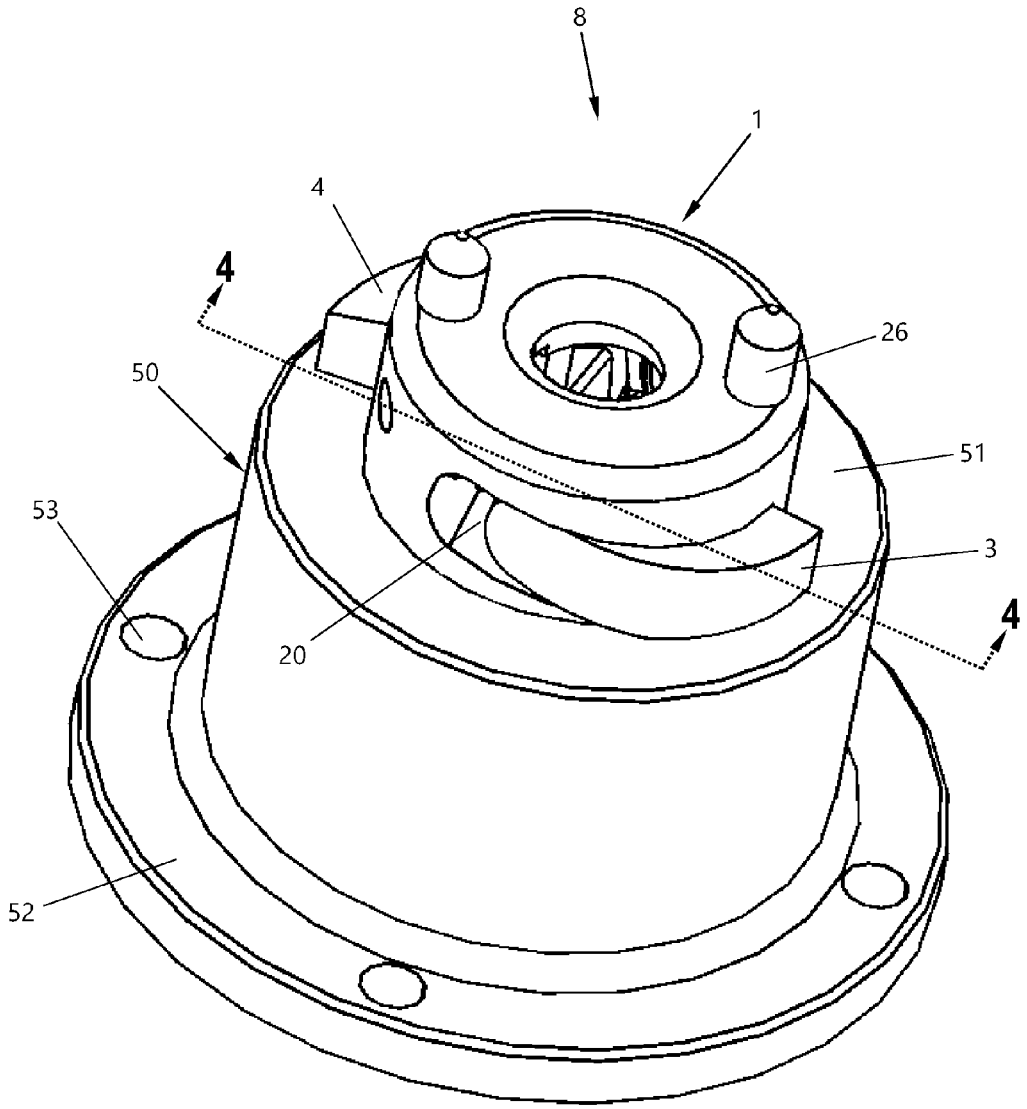
FIG. 3 is a perspective view of a kit according to the present invention comprising the drive head of FIG. 1 and a hub of a rotor.
Figure 4:
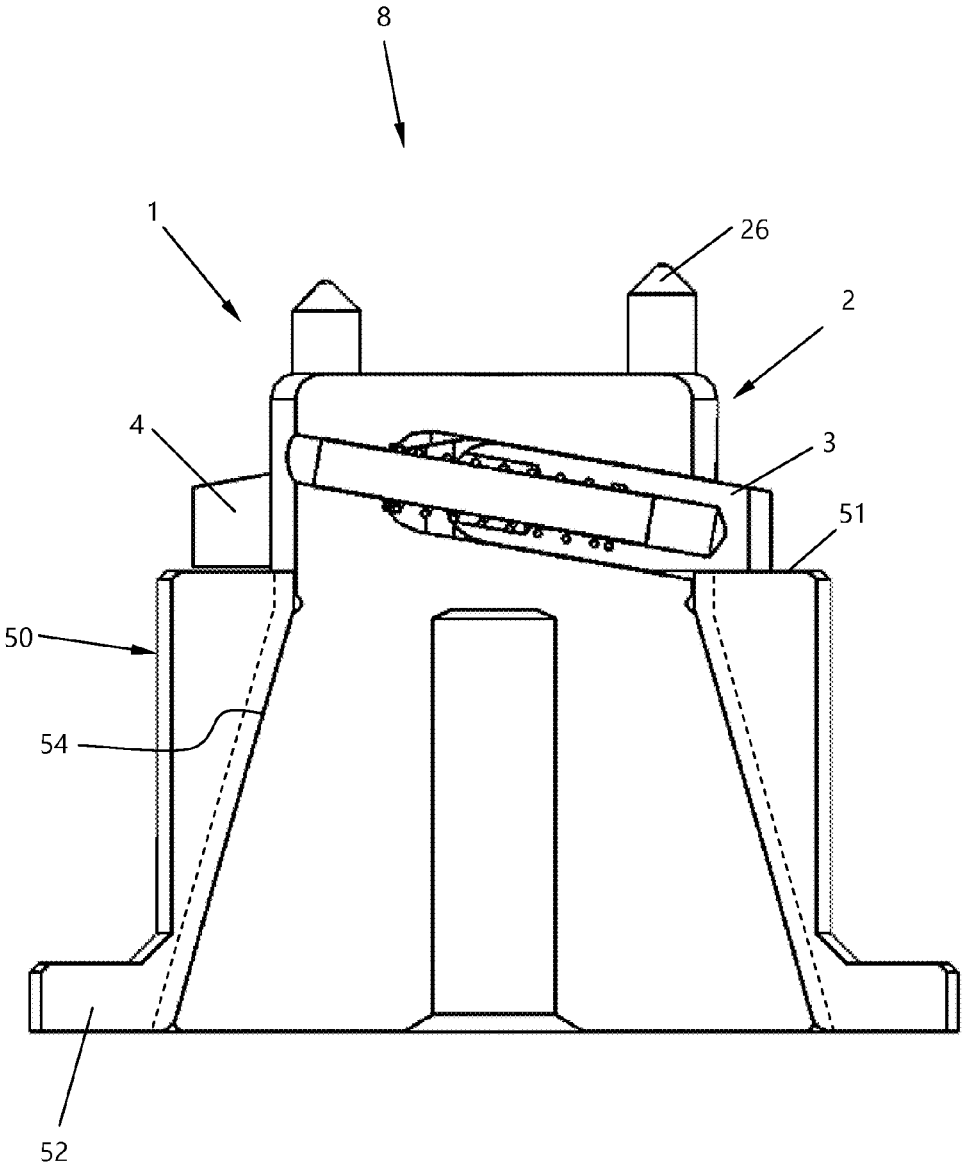
FIG. 4 is a cross-sectional view of the kit of FIG. 3 along line 4-4.

As described above, a great advantage of the linearly movable coupling elements according to the present invention compared to the prior art resides in the fact that the resting surfaces 30 and 40 of the coupling elements 3 and 4 can be designed as horizontal. Accordingly, the locking surfaces of the rotor hub are horizontal as well. This facilitates their manufacturing significantly compared to the prior art. For example, it is possible to create horizontal grooves in the rotor hub instead of grooves which must have a specific inclination. In another variant, which is described in FIGS. 3 and 4, the resting surfaces 30 and 40 of the coupling elements can simply come to rest on a horizontal upper edge of the rotor hub. FIGS. 3 and 4 show such a kit 8 comprising the drive head 1 of FIGS. 1 and 2 and a corresponding hub 50 that is normally mounted in the internal opening of an associated rotor. For attachment, several openings 53 are provided at a projecting bottom edge 52 of hub 50, via which the hub can be attached to the rotor by means of screw connections. For the sake of easier identification of the connection between the drive head and rotor hub, the rotor has however been omitted here.

The hub 50 essentially has a hat-like shape with a cylindrical main body and the already described ring-shaped flange edge 52. The hub 50 is hollow on the inside, it has a central passage opening and an inner jacket 54 shaped as a truncated cone, which is designed complementary to the truncated cone-shaped outer circumference 25 of the base body 2 of the drive head 1. The hub 50 can thus be put over the drive head 1 in the mounting direction A and in its end position comes to rest on the truncated cone-shaped region 25 of drive head 1 in such a way that the inner jacket 54 of hub 50 rests on the outer jacket of truncated cone-shaped region 25 in a form-locking manner. While being put over, the tapering truncated cone-like jacket 54 pushes the coupling elements 3 and 4 inwards against the spring load until they are inserted completely in the base body 2 of the drive head 1—and are thus in the release position F—upon reaching the upper edge of the passage opening of hub 50. If the hub 50 is pushed further downwards over the drive head 1 and thus the ring-like locking surface 51 passes the coupling elements 3 and 4, the coupling elements are released, pushed outwards into the locking position by the spring elements 7 and thus come to rest flat with their resting surfaces 30 and 40 on the ring-like locking surface 51 of hub 50. In this manner, the hub 50 is locked at the drive head 1 without any further assistance of the user being required. An unintended detaching of the hub and the drive head from each other is no longer possible. Separation of the two parts can only be achieved by actuating an actuation device which is not shown here but is basically known from the prior art, by means of which the coupling elements 3 and 4 is displaced into the release position against the spring load exerted by spring 7.

Figure 5:
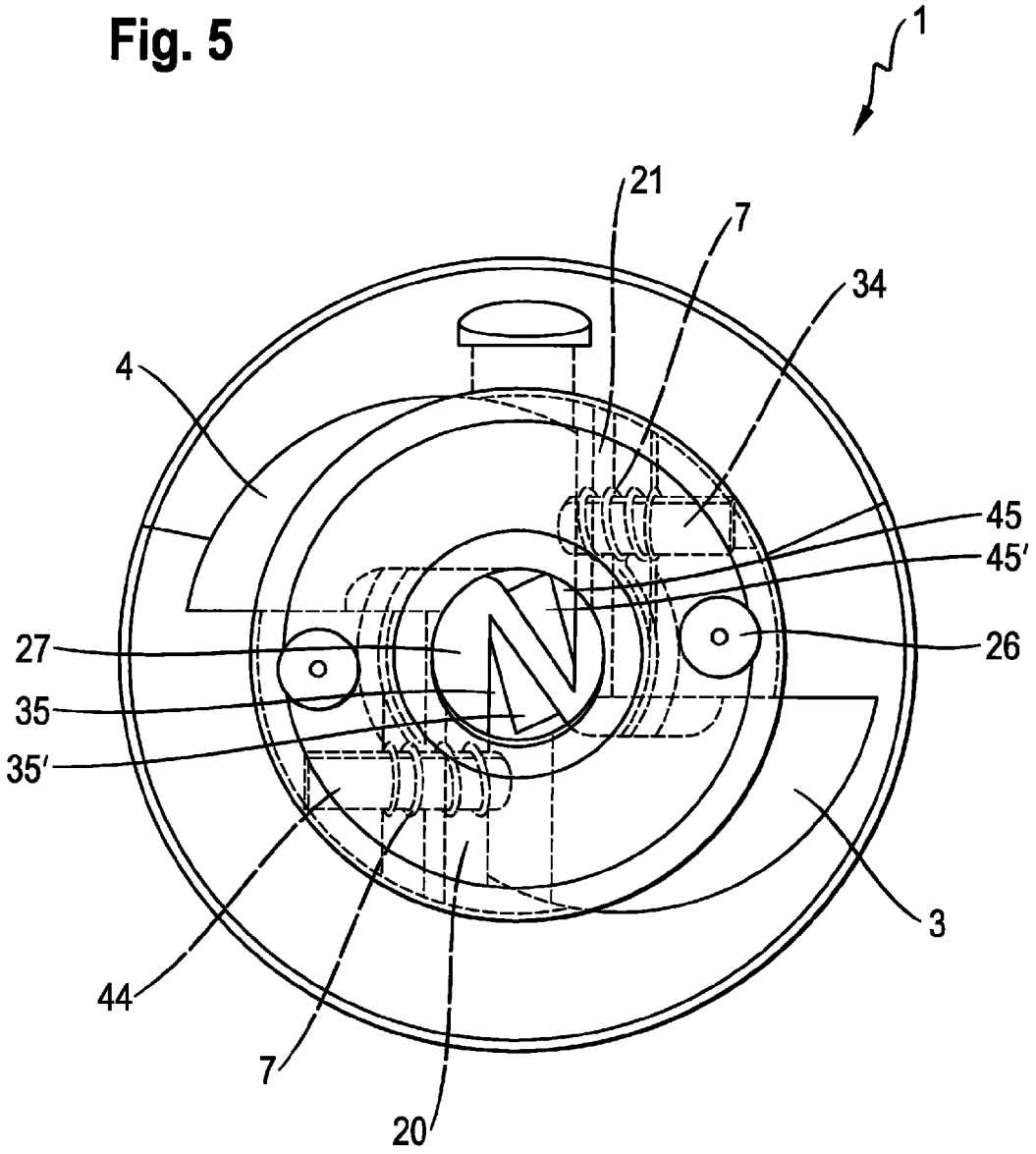
FIG. 5 is a partially transparent top view of another embodiment of a drive head according to the present invention.

FIG. 5 shows an alternative embodiment of a drive head 1 in top view from the mounting side A. The area in which the coupling elements 3 and 4 are located is shown partially transparent in order to illustrate the arrangement of the coupling elements. The coupling elements 3 and 4 are essentially similar to those shown in the previous figures. They are shown in their locking position. They are arranged inside openings 20 and 21 in the base body 2, which essentially correspond to those shown in the previous figures. The movement of the coupling elements 3 and 4 takes place along the guide pins 34 and 44, along which spring elements 7 set the coupling elements 3 and 4 under a pre-tension, thus urging them into the locking position in a manner similar to that described in the previous figures. The movement of the coupling elements 3 and 4 from the locking position back into the release position takes place by means of an actuation device, which comprises a rotatable shaft 27 having an essentially Z-shaped cross-section. Wedge projections 35 and 45 of the coupling elements 3 and 4 are positioned in the two wedge-shaped recesses of the shaft. A respective small triangular projection 35' or 45' is positioned on each of them. This assembly enables moving the coupling elements 3 and 4 into the base body 2 by means of their wedge shaped projections 35 and 45 by rotating the shaft 27 in clockwise direction, so that their ends do no longer protrude beyond the outer circumference of the base body 2.

Figure 6:
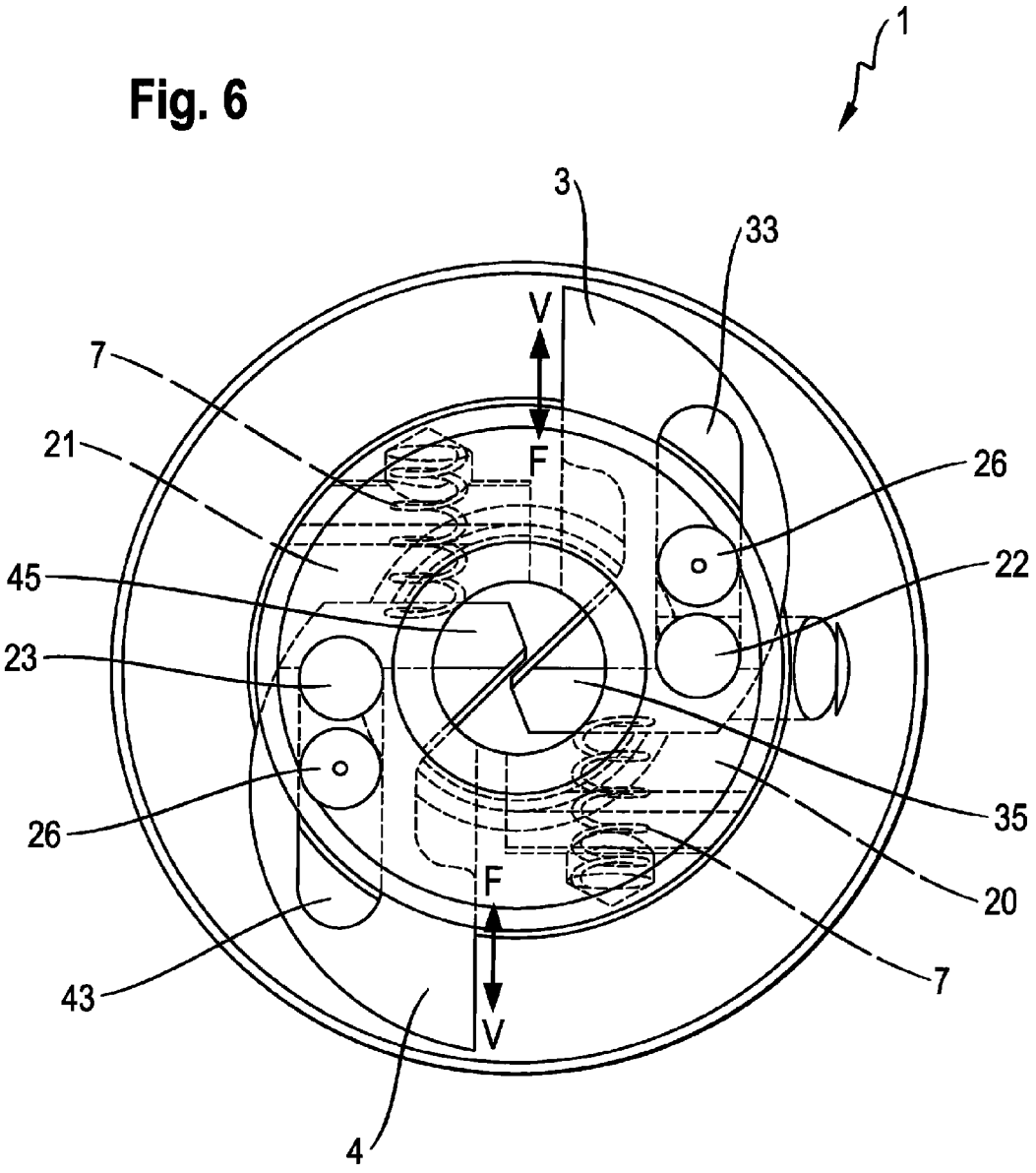
FIG. 6 is a partially transparent top view of a further embodiment of a drive head according to the present invention.

FIG. 6 shows a further embodiment of a drive head 1 according to the present invention shown in a manner comparable to FIG. 5. The locking elements are again shown in their locking position V. Their shape basically corresponds to that of the coupling elements described previously. However, they have a respective passage opening 33 or 43 extending in the longitudinal direction and throughout the entire thickness of the coupling elements 3 and 4 respectively. Two guide projections are provided in each longitudinal opening 33 and 43, namely in the first coupling element 3 the projections 22 and 26 and in the second coupling element 4 the projections 23 and 26. The projections are designed pin-like and have a diameter which corresponds to the width of the longitudinal openings 33 and 43. The projections 22, 23 and 26 are each firmly fixed to the base body of the drive head 1. As discussed in connection with FIG. 1, the projections 26 are designed as holding pins whose top ends engage in corresponding recesses of the rotor and align the latter with the drive head 1. If the coupling elements 3 and 4 are pushed from the locking position V into the release position F using an actuation device not shown here, the longitudinal openings 33 and 43 slide along the guide projections 22, 23 and 26, so that a linear movement of the coupling elements 3 and 4 is enabled between defined positions F and V.

Figure 7:
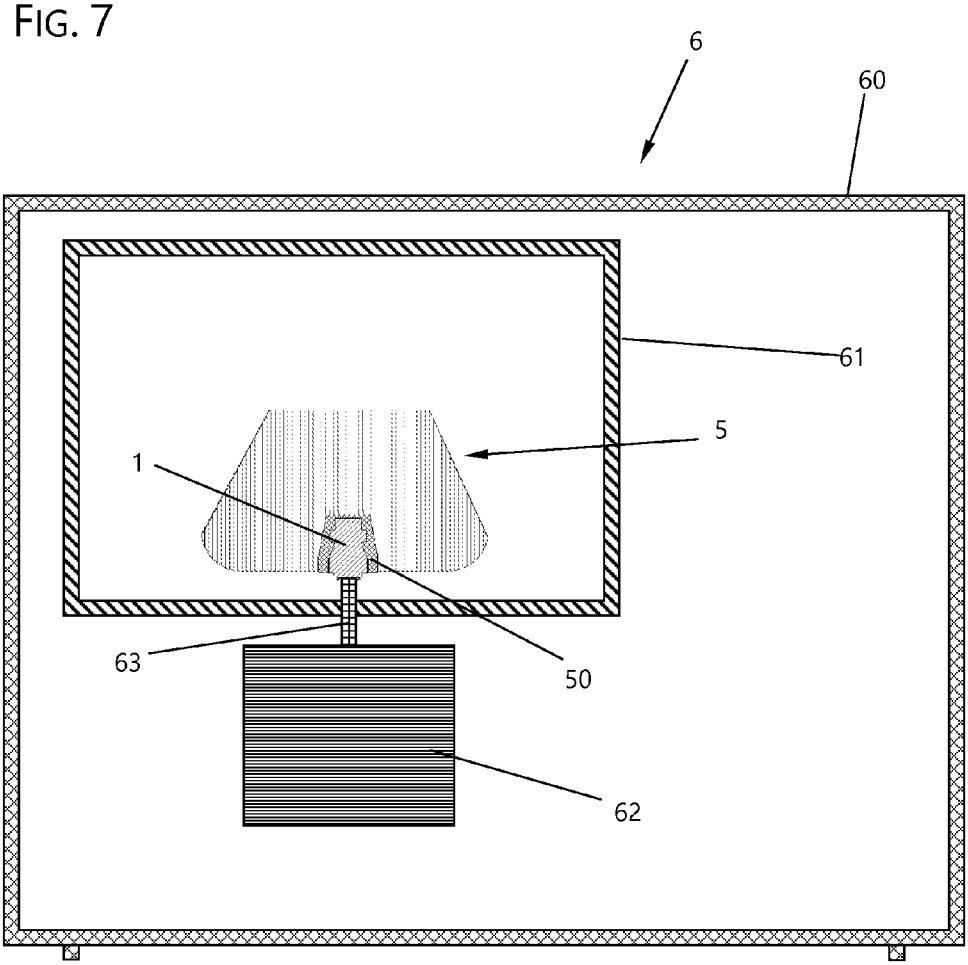
FIG. 7 is a cross-sectional view of a centrifuge according to the present invention.

Finally, FIG. 7 shows, in a greatly simplified form, a centrifuge 6 according to the present invention, which concerns a floor standing centrifuge. The use of the present invention in smaller equipment like a bench-top centrifuge is basically also feasible. Inside an external housing 60 there is disposed a rotor housing 61, in which a centrifuge rotor 5 is disposed. Said rotor is in turn connected to a hub 50 that is fitted to the drive head 1 and is locked in position on the same as described above by means of coupling elements, which are not shown here. The rotor 5 is caused to rotate by means of a motor 62 via a drive shaft 63.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A drive head for detachable connection of a drive with a rotor of a centrifuge, comprising:

a base body which is rotatable about an axis of rotation (R) and at least one coupling element, which is mounted on said base body so as to be movable between a release position (F) and a locking position (V), said coupling element protruding further beyond the outer circumference of the base body in the locking position (V) than in the release position (F), wherein the at least one coupling element is mounted on said base body so as to be linearly movable between the release position (F) and the locking position (V) in such a manner that a plane (E), along which the coupling element can be moved, has an inclination relative to a sectional plane (S) extending perpendicular to the axis of rotation (R), and that the coupling element, in its outer end region, has a resting surface running parallel to the sectional plane (S).

2. The drive head according to claim 1, wherein, as regarded from a mounting side (A) of the rotor, the at least one coupling element is mounted so as to be movable in an inclined downward direction, the angle of inclination ($\alpha$) of the plane (E) with respect to the sectional plane (S) being in the range of 5 to 30°.

3. The drive head according to claim 1, wherein the resting surface is located on the side of the coupling element facing away from a mounting side (A) of the rotor.

4. The drive head according to claim 1, wherein the at least one coupling element has an upper cover face facing towards a mounting side (A) of the rotor and a lower cover face more remote from the mounting side (A) of the rotor, which run parallel to each other.

5. The drive head according to claim 1, wherein the at least one coupling element is arranged in a recess in the base body in such a way that an upper cover face of the at least one coupling element rests flat on an upper boundary surface of the recess and a lower cover face of the at least one coupling element rests flat on a lower boundary surface of the recess.

6. The drive head according to claim 1, wherein an elastic element is provided which pre-tensions the coupling element in the direction of the locking position (V).

7. The drive head according to claim 6, wherein the elastic element comprises a spring.

8. The drive head according to claim 1, wherein the at least one coupling element comprises a guide groove, which extends in its movement direction and which receives at least one guide projection fixed to the base body.

9. The drive head according to claim 1, wherein, as regarded in a mounting direction of the rotor, the base body has an upper region, which has an essentially cylindrical outer contour, and a lower region shaped as a truncated cone adjoining the upper region, the coupling elements being arranged in the upper region.

10. A kit (8) for a centrifuge, wherein the kit comprises a drive head according to claim 1 and a hub for a rotor.

11. The kit according to claim 10, wherein the hub comprises at least one locking surface that runs parallel to the sectional plane (S) and is in contact with the resting surface of the at least one coupling element in the locking position (V) when the hub is mounted on the drive head.

12. The kit according to claim 11, wherein the locking surface is ring-shaped in such a way that is in contact with the resting surface of the at least one coupling element in the locking position (V) when the hub (50) is mounted on the drive head.

13. A centrifuge, comprising a kit according to claim 10.

14. A centrifuge, comprising a drive head according to claim 1.

15. The drive head according to claim 1, wherein, as regarded from a mounting side (A) of the rotor, the at least one coupling element is mounted so as to be movable in an inclined downward direction, the angle of inclination ($\alpha$) of the plane (E) with respect to the sectional plane (S) being in the range of 10 to 20°.

16. The drive head according to claim 1, wherein, as regarded from a mounting side (A) of the rotor, the at least one coupling element is mounted so as to be movable in an inclined downward direction, the angle of inclination ($\alpha$) of the plane (E) with respect to the sectional plane (S) being in the range of 10 to 17°.

* * * * *